US005296049A

United States Patent [19]

Ramanan et al.

[11] Patent Number: 5,296,049

[45] Date of Patent: Mar. 22, 1994

[54] IRON RICH METALLIC GLASSES HAVING HIGH SATURATION INDUCTION AND SUPERIOR SOFT FERROMAGNETIC PROPERTIES AT HIGH MAGNETIZATION RATES

[75] Inventors: V. R. V. Ramanan, Dover; Carl H. Smith, Chatham, both of N.J.

[73] Assignee: AlliedSignal Inc., Morristown, N.J.

[21] Appl. No.: 67,256

[22] Filed: May 25, 1993

Related U.S. Application Data

[60] Continuation of Ser. No. 774,493, Oct. 10, 1991, abandoned, which is a division of Ser. No. 537,221, Jun. 13, 1990, Pat. No. 5,062,909, which is a continuation of Ser. No. 379,763, Jul. 14, 1989, abandoned.

[51] Int. Cl.[5] ..... C21D 1/04

[52] U.S. Cl. ..... 148/108; 148/121; 29/605

[58] Field of Search ..... 148/108, 121, 122; 29/605

[56] References Cited

U.S. PATENT DOCUMENTS 4,142,571 3/1979 Narasimhan ..... 164/429
4,262,233 4/1981 Becker et al. ..... 148/108
4,298,409 11/1981 DeCristofaro et al. ..... 148/108
4,321,090 3/1982 Datta et al. ..... 148/304
4,379,004 5/1983 Makino et al. ..... 148/108
4,437,907 3/1984 Sato et al. ..... 148/108

*Primary Examiner*—John P. Sheehan
*Attorney, Agent, or Firm*—Ernest D. Buff; Gerhard H. Fuchs

[57] ABSTRACT

A magnetic metallic glass alloy exhibits, in combination, high saturation induction and low magnetic anisotropy energy. The alloy has a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" ranges from 0 to about 4, with up to about 1 atom percent of Mn being optionally present. Such an alloy is especially suited for use in large magnetic cores associated with pulse power applications requiring high magnetization rates. Examples of such applications include high power pulse sources for linear induction particle accelerators, induction modules for coupling energy from the pulse source to the beam of these accelerators, magnetic switches in power generators in inertial confinement fusion research, magnetic modulators for driving excimer lasers, and the like.

2 Claims, 6 Drawing Sheets

IRON RICH METALLIC GLASSES HAVING HIGH SATURATION INDUCTION AND SUPERIOR SOFT FERROMAGNETIC PROPERTIES AT HIGH MAGNETIZATION RATES

This application is a continuation of application Ser. NO. 774,493 filed Oct. 10, 1991, now abandoned, which is a division of application 537,221, filed Jun. 13, 1990 now U.S. Pat. No. 5,062,909, which in turn is a continuation of application Ser. No. 379,763 filed Jul. 14, 1989, now abandoned.

BACKGROUND OF THE INVENTION

1. Field of the Invention

This invention relates to iron-rich metallic glass alloys having high saturation induction that evidence particularly superior soft ferromagnetic properties when subjected to high magnetization rates.

2. Description of the Prior Art

Glassy metal alloys (metallic glasses) are metastable materials lacking any long range order. They are conveniently prepared by rapid quenching from the melt using processing techniques that are conventional in the art. Examples of such metallic glasses and methods for their manufacture are disclosed in U.S. Pat. Nos. 3,856,513, 4,067,732 and 4,142,571. The advantageous soft magnetic characteristics of metallic glasses, as disclosed in these patents, have been exploited in their wide use as materials in a variety of magnetic cores, such as in distribution transformers, switch-mode power supplies, tape recording heads and the like.

Applications for soft magnetic cores, in a particular class that is now receiving increased attention, are generically referred to as pulse power applications. In these applications, a low average power input, with a long acquisition time, is converted to an output that has high peak power delivered in a short transfer time. In the production of such high power pulses of electrical energy, very fast magnetization reversals, ranging up to 100 T/μs (or 100 MT/s), occur in the core materials. Examples of pulse power applications include saturable reactors for magnetic pulse compression and for protection of circuit elements during turn on, and pulse transformers in linear induction particle accelerators.

Metallic glasses are very well suited for pulse power applications because of their high resistivities and thin ribbon geometry, which allow low losses under fast magnetization reversals. (See, for example, (i) "Metallic Glasses in High-Energy Pulsed-Power Systems", by C. H. Smith, in *Glass . . . Current Issues*, A. J. Wright and J. Dupuy, eds., (NATO ASI Series E, No. 92, Martinus Nijhoff Pub., Dordrecht, The Netherlands, 1985) pp. 188–199.) Furthermore, metallic glasses, due to their noncrystalline nature, bear no magneto-crystalline anisotropy and, consequently, may be annealed to deliver very large flux swings, with values approaching the theoretical maximum value of twice the saturation induction of the material, under rapid magnetization rates. These advantageous aspects of metallic glass materials have led to their use as core materials in various pulse power applications: in high power pulse sources for linear induction particle accelerators, as induction modules for coupling energy from the pulse source to the beam of these accelerators, as magnetic switches in power generators, in inertial confinement fusion research, and in magnetic modulators for driving excimer lasers.

In a typical pulse power application, the core material is initially "parked" in, or biased into, a specific magnetic state through the imposition of appropriate external magnetic fields. For example, the application of a large, negative d.c. field will place the core material in a negatively saturated state. (The direction in which the core material will be driven into saturation during the application is referred to as the positive direction.) A subsequent removal of this field will position the core material at negative remanence. The former procedure allows for a maximum flux swing of twice the saturation induction in the core material but, as a matter of convenience, the latter procedure, known as the pulse reset, is most commonly employed. The maximum flux swing is then the sum of the remanent and saturation inductions. Henceforth, unless otherwise specified, the term "maximum flux swing", as used herein, connotes a value that is determined by the sum of the remanent and saturation inductions. Metallic glasses may easily be annealed to yield a value for $B_r$, the remanent induction, that is very close to $B_s$, the saturation induction. The input that is to be compressed, or transformed, in the application, is then applied to the core material.

Most pulse power applications require a high saturation induction in the core material, which leads to a large flux swing in the core. The core material should, preferably, also possess a low induced magnetic anisotropy energy. A low magnetic anisotropy energy leads to lower core losses, by facilitating the establishment of an optimal ferromagnetic domain structure, and therefore allow the cores to operate with greater efficiency. METGLA® 2605CO (nominal composition: $Fe_{66}Co_{18}B_{15}Si_1$), available from Allied-Signal Inc., is a high induction metallic glass alloy currently used in many of the pulse power applications recited above. This metallic glass is taught by U.S. Pat. No. 4,321,090, wherein metallic glasses having a high saturation induction are disclosed. The saturation induction of this glassy alloy is about 1.75 T. However, the high cobalt content in this alloy imparts a high value for the magnetic anisotropy energy and, consequently, high core losses. The value of about 900 J/m$^3$ for the magnetic anisotropy energy in this alloy is among the highest obtained in metallic glasses. In spite of its high induction, a maximum flux swing of only about 3.2 T is attainable from this alloy. Furthermore, the high Co content in this alloy leads to high raw material costs. Considering that the cores used in pulse power applications may contain as much as 100 kg of core material per core, and considering that Co had been classified as a strategic material, a more economical alloy containing substantially reduced levels of Co is highly desirable.

A metallic glass alloy that contains no cobalt is METGLAS®2605SC (nominal composition: $Fe_{81}B_{13.5}Si_{3.5}C_2$), available from Allied-Signal Inc. This alloy is disclosed in U.S. Pat. No. 4,219,355. The low magnetic anisotropy energy (about 100 J/m$^3$) of this alloy has been exploited in certain pulse power applications. However, the lower saturation induction (about 1.57 T) and a correspondingly lower maximum flux swing (about 2.9 T) available from this alloy have deterred widespread use of this alloy in pulse power applications.

A metallic glass alloy that offered a combination of high induction (large flux swings) and low magnetic anisotropy energy would be highly desirable for the purpose of pulse power applications. An additional advantage would be derived if such an alloy were to offer economy in production costs.

SUMMARY OF THE INVENTION

The present invention provides iron-rich magnetic alloys that are at least about 80% glassy and are characterized by a combination of high saturation induction and low magnetic anisotropy energy. Generally stated, the glassy metal alloys of the invention have a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" ranges from 0 to about 4. These alloys may, optionally, contain up to about 1 atom percent of Mn. The metallic glasses of the invention, when suitable annealed, additionally evidence large values for the dc swing from negative remanence to positive saturation. In the alloys of the invention, the saturation induction ranges from about 1.55 T to about 1.75 T, the magnetic anisotropy energy ranges between about 300 J/m$^3$ and 400 J/m$^3$, and the above mentioned dc swing typically ranges from about 2.9 T to about 3.2 T.

The metallic glasses of this invention are especially suitable for use in large magnetic cores used in various pulse power applications requiring high magnetization rates. Representative of such applications are high-power pulse sources for linear induction particle accelerators, induction modules for coupling energy from the pulse source to the beam of these accelerators, magnetic switches in power generators in inertial confinement fusion research and magnetic modulators for driving excimer lasers. Other uses include cores of airborne transformers, current transformers, ground fault interrupters, switch-mode power supplies, and the like.

BRIEF DESCRIPTION OF THE DRAWINGS

The invention will be more fully understood and further advantages will become apparent when reference is made to the following detailed description of the preferred embodiments of the invention and the accompanying drawings in which.

DESCRIPTION OF THE PREFERRED EMBODIMENTS

Figure 1:
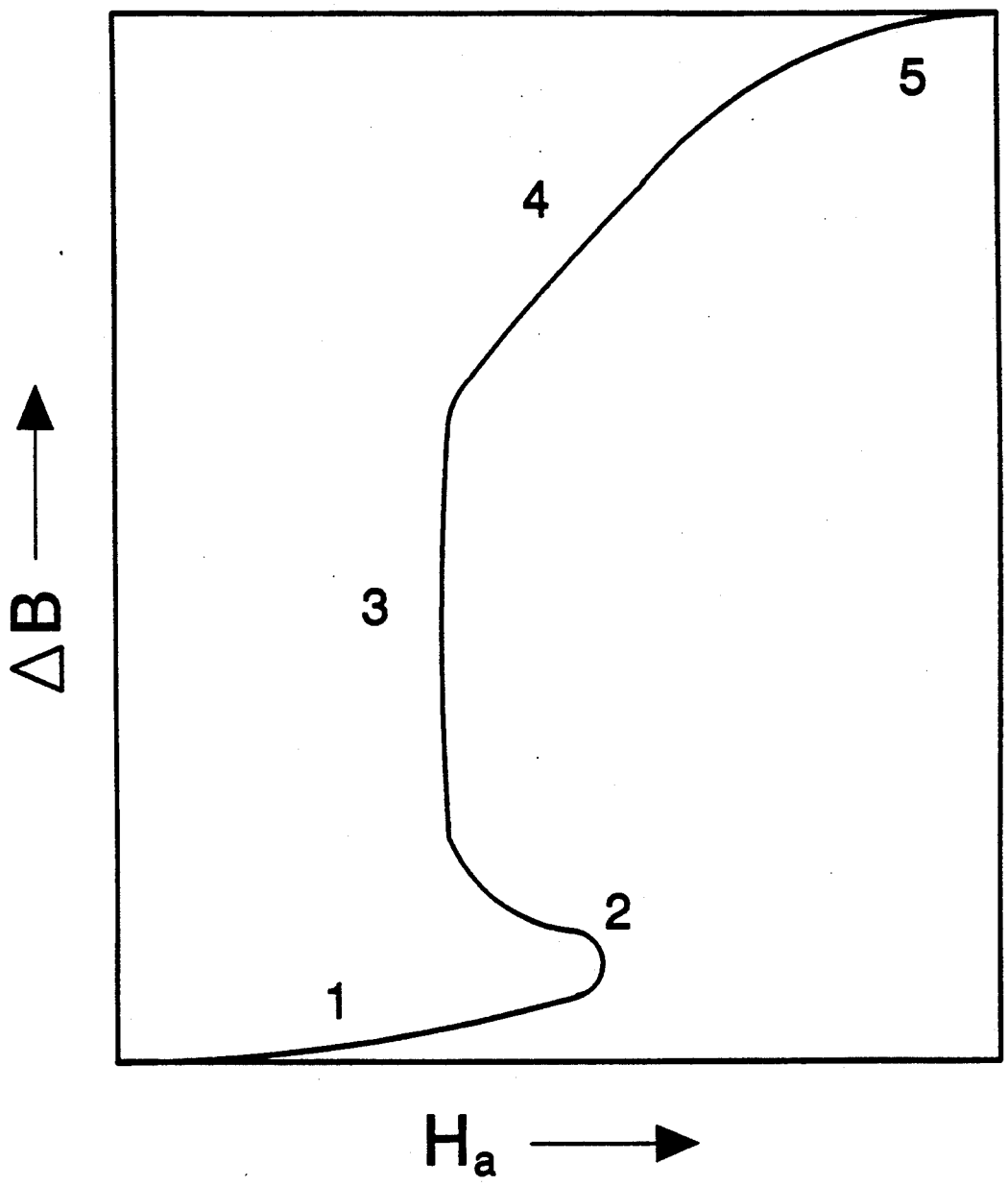
FIG. 1 is a schematic representation of the dynamic magnetization curve obtained when a ferromagnetic material is subjected to very high magnetization rates, wherein $H_d$ is the applied field and $\Delta B$ is the total change in induction.

In accordance with the present invention, there are provided iron-rich magnetic metallic glass alloys that are at least about 80% glassy and are characterized by a combination of high saturation induction and low magnetic anisotropy energy. Generally stated, the glassy metal alloys of the invention have a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" ranges from 0 to about 4. These alloys may, optionally, contain up to about 1atom percent of Mn. The purity of the above compositions is that found in normal commercial practice. The metallic glasses of the invention, when suitably annealed, additionally evidence large values for the dc swing from negative remanence to positive saturation. In the alloys of the invention, the saturation induction ranges from about 1.55 T to about 1.75 T, the magnetic anisotropy energy ranges between about 300 J/m$^3$ and 400 J/m$^3$, and the above mentioned dc swing typically ranges from about 2.9 T to about 3.2 T.

Since the presence of even small fractions of crystallinity in an otherwise glassy alloy tends to impair the optimal soft magnetic performance of the alloy, the alloys of the invention are preferably at least 90% glassy, and most preferably 100% glassy, as established by X-ray diffraction. Furthermore, the glassy alloys of the invention that evidence a saturation induction of at least about 1.6 T are to be especially preferred from the point of view of pulse power applications.

Examples of metallic glasses of the invention include $Fe_{75}Co_6B_{14}Si_3C_2$, $Fe_{77}Co_6B_{12}Si_3C_2$, $Fe_{78}Co_6B_{12}Si_3C_1$, $Fe_{79}Co_2B_{14}Si_3C_2$, $Fe_{76}Co_6B_{15}Si_1C_2$, $Fe_{78}Co_6B_{12}Si_1C_3$, $Fe_{77}Co_7B_{12}Si_2C_2$, $Fe_{80}Co_6B_{11}Si_1C_2$, $Fe_{78}Co_6B_{12}Si_2C_2$ $Fe_{76}Co_6B_{14}Si_3Mn_1$, $Fe_{78}Co_8B_{11}Si_3$, $Fe_{81}Co_2B_{14}Si_3$, $Fr_{83}Co_2B_{13}Si_1$ and $Fe_{79}Co_6B_{12}Si_3$.

The importance of a high saturation induction in an alloy targeted for use in pulse power applications, such as a magnetic switch, may be understood as follows: Given that the units for saturation induction are volt-second per meter squared (Vs/m$^2$), [1 (Vs/m$^2$) = 1 T], a magnetic core of a given cross-sectional area will "hold off" a known amount of Vs from the output. Therefore, under a fixed input voltage level, the hold-off time is greater when the core material has a greater saturation induction.

The presence of Co in the alloys serves to increase the saturation induction level. Cobalt contents of less than about 2 at. % provide only marginal increases in saturation induction levels over alloys containing no cobalt. The rate of increase of saturation induction due to the presence of Co reduces substantially above about 8 at. % Co, and higher levels of Co are therefore not desired because of the substantial cost of the element.

The alloys of the invention that contain carbon are preferred alloys of the invention, for a variety of reasons: First, the introduction of C in the alloys has been found to increase even further the saturation induction levels of the alloys. This increase is especially notable in alloys containing between about 11 and 14 at. % boron. For this reason, alloys of the invention having a B content ranging between about 11 at. % and about 14 at. % are more preferred.

It has also been observed that the increased saturation induction levels are obtained from C additions only to a level of about 2 at. %, beyond which level the saturation induction level of the alloys tarts to drop. For this reason, the alloys of the invention containing the combination of B ranging from about 11 at. % to about 14 at. % and C ranging from about 0.5 at. % to about 2 at. % are especially preferred. The data in Table I serve to illustrate the effects of C on the saturation induction of the alloys of the invention.

TABLE I

Data showing the beneficial effects of C on the saturation induction, $B_s$, of the alloys of this invention.

| Composition (at. %) | $B_s$ (T) |
|---|---|
| $Fe_{79}Co_6B_{12}Si_3$ | 1.66 |
| $Fe_{77}Co_6B_{14}Si_3$ | 1.64 |
| $Fe_{81}Co_2B_{14}Si_3$ | 1.60 |
| $Fe_{79}Co_6B_{14}Si_2C_1$ | 1.74 |
| $Fe_{78}Co_6B_{12}Si_3C_1$ | 1.77 |
| $Fe_{77}Co_6B_{12}Si_3C_2$ | 1.73 |
| $Fe_{76}Co_6B_{12}Si_3C_3$ | 1.71 |
| $Fe_{75}Co_6B_{12}Si_3C_4$ | 1.64 |
| $Fe_{76}Co_6B_{14}Si_3C_1$ | 1.69 |
| $Fe_{74}Co_6B_{14}Si_3C_3$ | 1.66 |
| $Fe_{80}Co_2B_{14}Si_3C_1$ | 1.65 |
| $Fe_{79}Co_2B_{14}Si_3C_2$ | 1.63 |

The second reason for requiring the presence of C in the preferred alloys of the invention is that the handling characteristics of an iron-rich alloy melt are improved with the introduction of C in the melt. From the point of view of large scale production of rapidly solidified ribbons of metallic glasses, improved handling characteristics of the alloy melt are an important asset. The maximum amount of about 4 at. % for C in the alloys of the invention offers an acceptable compromise between the loss of saturation induction levels and the improvements in melt handling characteristics. It will be noted from Table I that the saturation induction of an alloy with at. % C is approximately the same as in an alloy without any carbon.

It is further believed that the presence of C in the alloys of the invention helps to reduce the magnetic anisotropy energy of the alloys. The magnetic anisotropy energy of a ferromagnetic material is a measure of the energy required to rotate the magnetic moments in the material away from an established, preferred direction of alignment. The magnitude of this energy dictates the ease with which a particular domain structure may be established in the material.

The importance of a low magnetic anisotropy energy, and the consequent reduction of core losses, in an alloy targeted for use in pulse power applications is illustrated in FIG. 1. This figure is a schematic representation of the dynamic magnetization curves ("B-H loops") obtained from ferromagnetic materials which are subjected to high magnetization rates; $H_a$ is the applied magnetic field on the core material and $\Delta B$ is the flux swing obtained from the core material. As noted in the figure, this magnetization curve may be broken down to five regions (or parts) of magnetic response from the core material.

In region I, after a rapid increase usually limited by stray inductances, $H_a$ reaches a maximum and then actually decreases in many cases. This peak in region II is associated with the establishment of bar shaped ferromagnetic domains spanning the ribbon thickness, the minimum in H corresponding to the attainment of an efficient domain wall spacing. Magnetization progresses by the motion of these bar domain walls in region III, costing very little in $H_a$. Towards the end of region III, the higher mobility of the portion of the domain walls near the ribbon surface soon results in a single domain wall which encircles the interior of the ribbon, and is generally referred to as the "sandwich" domain. While no detailed understanding is available, it is generally understood in the art that the magnetization behavior in region IV is related to the progression of this sandwich domain, before saturation is attained in region V.

The area enclosed by the dynamic magnetization curve and the ordinate axis in FIG. 1 represents the core loss of the magnetic core material. This core loss is really a "half-cycle" loss, in that only one-half of a conventional hysteresis loop is being traversed by the material. Henceforth, all references to core losses of materials, whether of this invention or not, in connection with the description of this invention will imply these half-cycles losses.

It is clear from FIG. 1 that the core loss may be reduced if the efficiency of establishment of the bar domains is improved upon, i.e., if the "knee" in region II is shortened. Since this efficiency is directly related to the ferromagnetic anisotropy energy, an alloy targeted for use in pulse power applications should preferably have a low magnetic anisotropy energy.

It is well understood in the art that the magnetic anisotropy energy of metallic glasses in the Fe-B-Si system may be reduced by the addition of suitable amounts of a fourth element. As mentioned above, carbon is one such element. examples of other such elements include Mo, Nb, V, and Cr.

It has been unexpectedly found, however, that, in the Fe-Co-B-Si system of metallic glasses, C is the only elemental addition that increases the saturation induction level of the "parent" alloy. All other attempted elemental additions reduce the saturation induction by substantial amounts. Table II illustrates these findings. For these reasons, the various elemental additions listed in Table II, except for carbon, should be excluded from a metallic glass alloy targeted for use in magnetic cores of application, such as pulse power applications, which demand high saturation induction levels in the core material.

TABLE II

Data illustrating that, except for carbon, additional elements introduced to Fe—Co—B—Si metallic glasses have deleterious effects on saturation induction. In this Table, the first three named alloys are metallic glasses belonging to this invention, while all other named alloys fall outside the scope of this invention.

| Composition (at. %) | $B_s$ (T) |
|---|---|
| $Fe_{77}Co_6B_{14}Si_3$ | 1.64 |
| $Fe_{76}Co_6B_{14}Si_3C_1$ | 1.69 |
| $Fe_{75}Co_6B_{14}Si_3C_2$ | 1.67 |
| $Fe_{76}Co_6B_{14}Si_3Mo_1$ | 1.57 |
| $Fe_{75}Co_6B_{14}Si_3Mo_2$ | 1.49 |
| $Fe_{76}Co_6B_{14}Si_3Nb_1$ | 1.57 |
| $Fe_{75}Co_6B_{14}Si_3Nb_2$ | 1.48 |
| $Fe_{75}Co_6B_{14}Si_3V_2$ | 1.47 |
| $Fe_{75}Co_6B_{14}Si_3Cr_2$ | 1.47 |
| $Fe_{75}Co_6B_{14}Si_3Ti_2$ | 1.47 |
| $Fe_{75}Co_6B_{14}Si_3Zr_2$ | 1.47 |
| $Fe_{75}Co_6B_{14}Si_3Hf_2$ | 1.53 |
| $Fe_{75}Co_6B_{14}Si_3W_2$ | 1.53 |

The effect of Si in the alloys of the invention is to reduce the saturation induction but increase the thermal stability of the glassy state of the alloys by increasing their crystallization temperatures. The maximum level of about 4 at. % Si in the alloys of this invention defines an acceptable balance between these two effects of Si.

Figure 2:
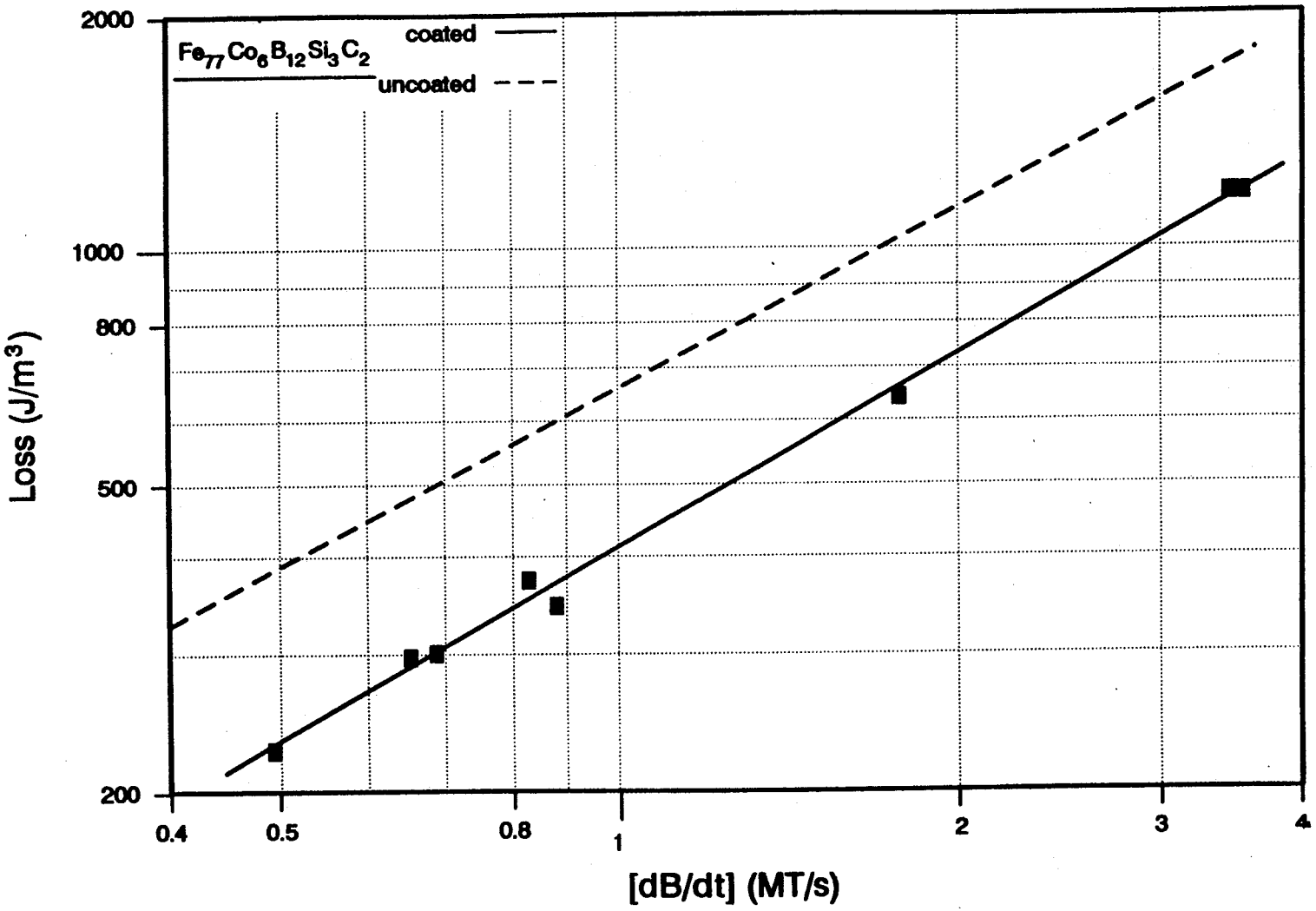
FIG. 2 is a plot, on a log-log scale, of the core loss as a function of the magnetization rate, (dB/dt), for a preferred metallic glass of the invention, illustrating the beneficial effects on the core which result from coating the ribbon surfaces.

It is well known in the art that the core losses in a magnetic core may be reduced through the use of insulative coatings on the surfaces of the core material. Such is indeed the case also with cores prepared from the alloys of this invention. Depending on the materials and techniques employed, such coatings minimize or eliminate interlaminar electrical shorts in the core, leading to a reduction or elimination of the contribution to the total core loss from interlaminer eddy currents. FIG. 2, in a plot of loss vs. the magnetization rate (dB/dt), illustrates the extent of reduction in core loss that may be obtained in a preferred alloy of this invention.

The data in this figure were obtained from toroidal cores of the same geometry, prepared from about the same mass of coated and uncoated 50 mm wide ribbons of the alloy, and subjected to identical anneals. The range of magnetization rates that were investigated is illustrated in the data points shown in this figure for the coated ribbon. In all other cases, in this and other figures used in connection with the description of this invention, only lines that are linear regression fits to data are shown, for the sake of clarity. Coated ribbons were obtained by dipping as-cast ribbons in a diluted solution of colloidal silica. The host solution was isopropanol in the commercially available colloid, and methanol was used for dilution. In the range of dilution levels from about 6:1 to about 10:1 that was studied, the losses obtained from the coated ribbons were found to be about the same. Other dilution levels may yield greater reductions. It should be apparent to one well versed in the art that various combinations of other coating techniques, such as spray coating or sputter coating, and other coating materials, such as magnesia or organic films such as Polyimide, may be employed to achieve similar or greater reductions in the core loss of the materials of this invention. Similarly, it would also be apparent that, depending on the coating material, the ribbon may be annealed prior to being coated.

Figure 3:
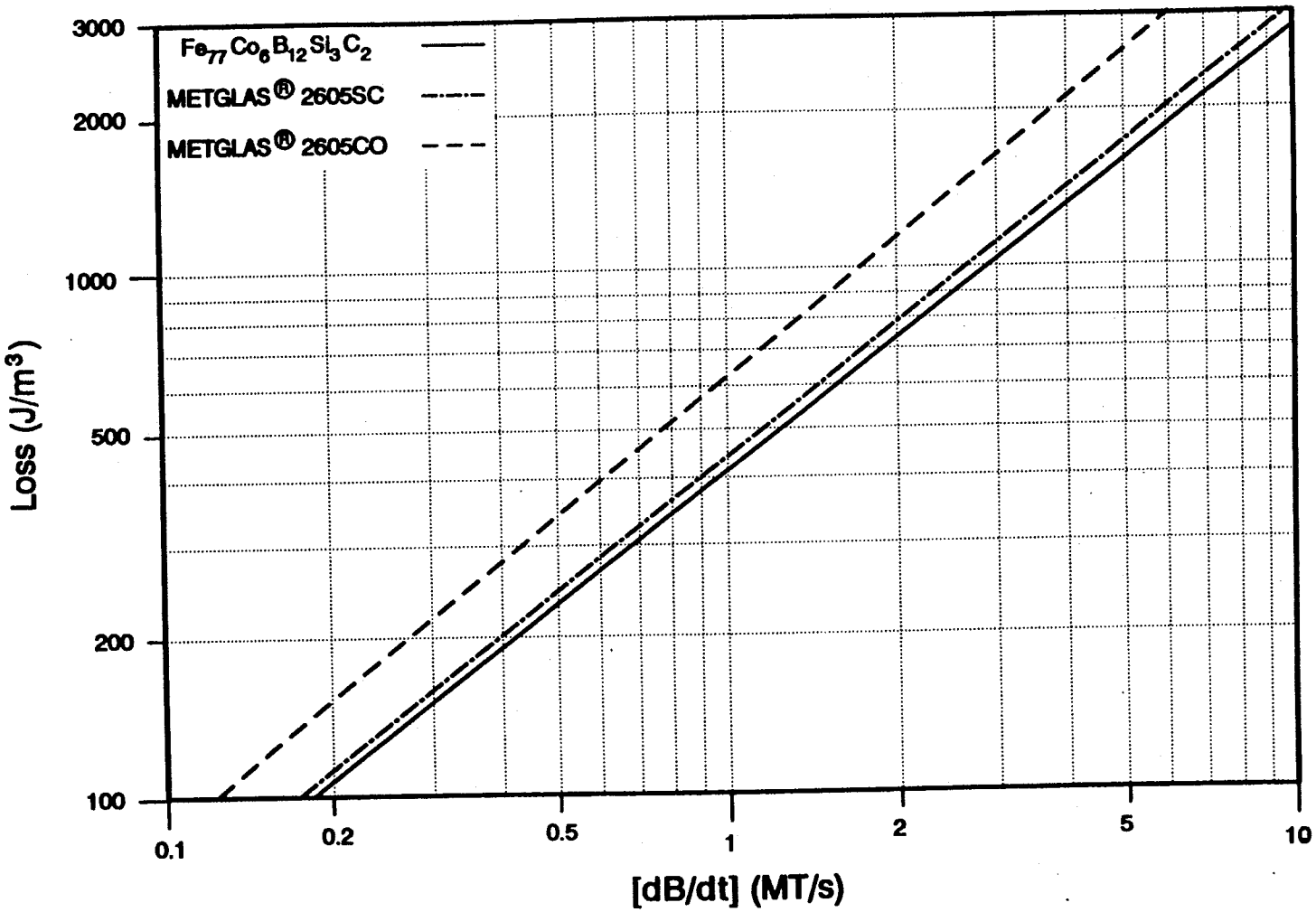
FIG. 3 in a similar plot, compares the losses obtained from a preferred metallic glass of the invention against the losses obtained from two prior art metallic glasses that are now commercially used in cores for pulse power applications, all data for this figure being derived from coated and annealed ribbons.

FIG. 3 compares the losses obtained from the same alloy of FIG. 2 with the losses obtained from two prior art metallic glasses that are now commercially used in cores for pulse power applications, as a function of the magnetization rate. Fifty millimeter wide ribbons of all three alloys referred in this figure were coated as detailed above, and annealed under their respective optimal conditions. The reduced levels of losses attainable, over a wide range of magnetization rates, in the alloy of this invention are illustrated by this figure.

Figure 4:
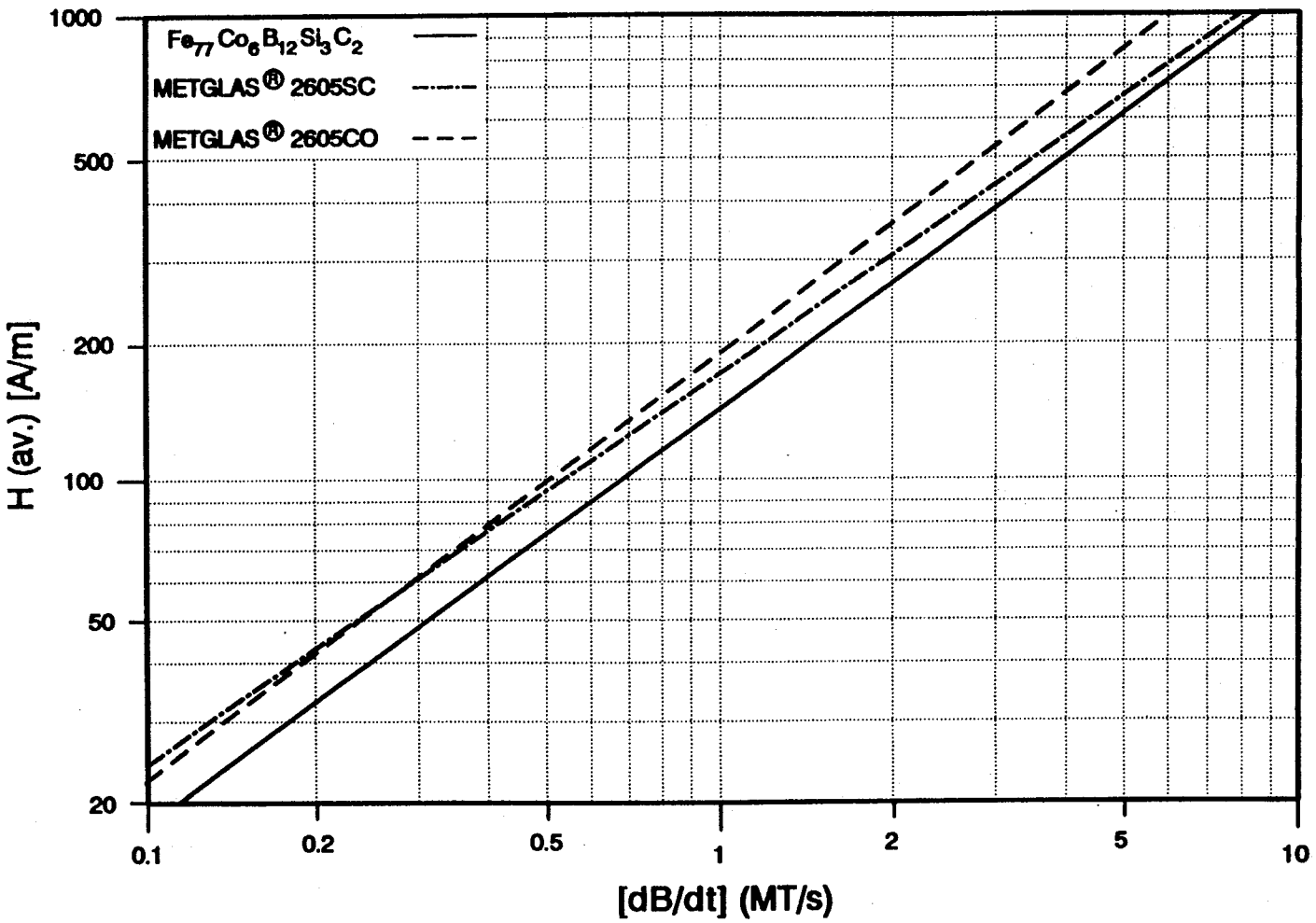
FIG. 4 in a similar plot, for the same alloy ribbons as in FIG. 3, shows the values for the average field, H (ave.), as a function of the magnetization rate, (dB/dt), with H (ave.) being defined as the core loss per unit change in induction, $\Delta B$.

Each of the three alloys illustrated by FIG. 3 evidences a different maximum flux swing. Consequently, a more direct measure of the performance of an alloy in pulse power applications is the average field, H (ave.), defined as the core loss for a maximum flux swing of 1 T. This field is obtained by dividing the measured core loss by the measured maximum flux swing. FIG. 4, in a plot of H (ave.) vs. (dB/dt) for the same ribbons as in FIG. 3, uses this performance measure to illustrate the superior performance characteristics typical of the alloys of this invention, when compared with commercial, prior art metallic glasses.

The following examples are presented to provide a more complete understanding of the invention. The specific techniques, conditions and reported data set forth to illustrate the principles and practice of the invention are exemplary and should not be construed as limiting the scope of the invention. All alloy compositions described in the examples are nominal compositions.

EXAMPLES

Glassy metal alloys, designated as samples no. 1 to 47 in Table III, were rapidly quenched from the melt following the techniques taught by Narasimhan in U.S. Pat. No. 4,142,571, the disclosure of which is hereby incorporated by reference thereto. All casts were made in a vacuum chamber, using 0.025 to 0.100 kg melts comprising constituent elements of high purity. The resulting ribbons, typically 25 to 30 μm thick and about 6 mm wide, were determined to be free of crystallinity by x-ray diffractometry using Cu-$K_\alpha$ radiation and differential scanning calorimetry. Some of the alloys were also cast separately as 50 mm wide ribbons, to facilitate a direct comparison with commercial alloys. Each of the alloys was at least 80% glassy, most of them more than 90% glassy and, in many instances, the alloys were 100% glassy. Ribbons of these glassy metal alloys were strong, shiny, hard and ductile.

A commercial vibrating sample magnetometer was used for the measurement of the saturation magnetic moment of these alloys. As-cast ribbon from a given alloy was cut into several small squares (approximately 2 mm×2 mm), which were randomly oriented about a direction normal to their plane, their plane being parallel to a maximum 25. applied field of about 755 kA/m. By using the measured mass density, the saturation induction, $B_s$, was then calculated. The density of many of these alloys was measured using standard techniques invoking Archimedes' Principle.

The core losses were measured on closed-magnetic path toroidal samples. The toroidal samples were prepared by winding continuous ribbons of the glassy metal alloys onto ceramic bobbins (about 40 mm O.D.), so that the mean magnetic path length was about 0.13 m. Each toroidal sample contained between about 0.002 kg and 0.01 kg of ribbon. All toroids were annealed prior to the loss measurements. The anneal temperatures ranged between about 573 K and 623 K, the anneal times ranged between about 900 s and 3600 s, and an external field ranging in strength from about 400 A/m to about 1600 A/m was imposed on the toroids throughout the anneal cycle.

The toroids were driven by discharging a low inductance capacitor bank through a set of insulated primary windings, numbering from about 3 to about 10. The current in the primary windings was measured using a commercial current probe. A one turn secondary winding provided a voltage proportional to (dB/dt), the magnetization rate. The voltage and current waveforms were digitized at 20 ns per point and recorded on a digital oscilloscope. The core loss, the applied field and the maximum flux swing were then calculated by processing these stored waveforms. A separate set of windings, numbering between about 5 and 10, was used to apply a pulse reset field before the toroid was magnetized, to allow a maximum flux swing from negative remanence to positive saturation.

TABLE III

Values for saturation induction, $B_s$, obtained from various metallic glasses belonging to this invention.

| No. | | Fe | Co | B | Si | C | Mn | $B_s$ (T) |
|---|---|---|---|---|---|---|---|---|
| 1 | at. % | 84 | 2 | 13 | 1 | 0 | 0 | 1.60(*) |

TABLE III-continued

Values for saturation induction, $B_s$, obtained from various metallic glasses belonging to this invention.

| No. | | Fe | Co | B | Si | C | Mn | $B_s$ (T) |
|---|---|---|---|---|---|---|---|---|
| | wt. % | 94.2 | 2.4 | 2.8 | 0.6 | 0 | 0 | |
| 2 | at. % | 81 | 2 | 14 | 3 | 0 | 0 | 1.60 |
| | wt. % | 92.8 | 2.4 | 3.1 | 1.7 | 0 | 0 | |
| 3 | at. % | 81 | 2 | 13.5 | 3.5 | 0 | 0 | 1.64 |
| | wt. % | 92.6 | 2.4 | 3.0 | 2.0 | 0 | 0 | |
| 4 | at. % | 80 | 4 | 13 | 3 | 0 | 0 | 1.59 |
| | wt. % | 90.7 | 4.8 | 2.9 | 1.7 | 0 | 0 | |
| 5 | at. % | 79 | 4 | 13.5 | 3.5 | 0 | 0 | 1.63(*) |
| | wt. % | 90.2 | 4.8 | 3.0 | 2.0 | 0 | 0 | |
| 6 | at. % | 79 | 4 | 14 | 3 | 0 | 0 | 1.59 |
| | wt. % | 90.3 | 4.8 | 3.1 | 1.7 | 0 | 0 | |
| 7 | at. % | 79 | 6 | 12 | 3 | 0 | 0 | 1.66 |
| | wt. % | 88.6 | 7.1 | 2.6 | 1.7 | 0 | 0 | |
| 8 | at. % | 77 | 6 | 14 | 3 | 0 | 0 | 1.64 |
| | wt. % | 87.9 | 7.2 | 3.1 | 1.7 | 0 | 0 | |
| 9 | at. % | 76 | 6 | 15 | 3 | 0 | 0 | 1.65 |
| | wt. % | 87.6 | 7.3 | 3.3 | 1.7 | 0 | 0 | |
| 10 | at. % | 75 | 6 | 16 | 3 | 0 | 0 | 1.64(*) |
| | wt. % | 87.3 | 7.4 | 3.6 | 1.8 | 0 | 0 | |
| 11 | at. % | 78 | 8 | 11 | 3 | 0 | 0 | 1.70(*) |
| | wt. % | 86.6 | 9.4 | 2.4 | 1.7 | 0 | 0 | |
| 12 | at. % | 72 | 8 | 16 | 4 | 0 | 0 | 1.62 |
| | wt. % | 84.2 | 9.9 | 3.6 | 2.4 | 0 | 0 | |
| 13 | at. % | 80 | 2 | 14 | 3 | 1 | 0 | 1.65 |
| | wt. % | 92.4 | 2.4 | 3.1 | 1.7 | 0.2 | 0 | |
| 14 | at. % | 79 | 2 | 14 | 3 | 2 | 0 | 1.63 |
| | wt. % | 92.1 | 2.5 | 3.2 | 1.8 | 0.5 | 0 | |
| 15 | at. % | 79 | 2 | 13.5 | 3.5 | 2 | 0 | 1.56(*) |
| | wt. % | 92.0 | 2.5 | 3.0 | 2.0 | 0.5 | 0 | |
| 16 | at. % | 78 | 2 | 14 | 3 | 3 | 0 | 1.59 |
| | wt. % | 91.8 | 2.5 | 3.2 | 1.8 | 0.8 | 0 | |
| 17 | at. % | 78 | 2 | 14 | 2 | 4 | 0 | 1.63 |
| | wt. % | 92.1 | 2.5 | 3.2 | 1.2 | 1.0 | 0 | |
| 18 | at. % | 77 | 2 | 14 | 3 | 4 | 0 | 1.56 |
| | wt. % | 91.5 | 2.5 | 3.2 | 1.8 | 1.0 | 0 | |
| 19 | at. % | 80 | 6 | 11 | 1 | 2 | 0 | 1.75 |
| | wt. % | 89.5 | 7.1 | 2.4 | 0.6 | 0.5 | 0 | |
| 20 | at. % | 79 | 6 | 12 | 1 | 2 | 0 | 1.73 |
| | wt. % | 89.2 | 7.1 | 2.6 | 0.6 | 0.5 | 0 | |
| 21 | at. % | 79 | 6 | 12 | 2 | 1 | 0 | 1.74 |
| | wt. % | 88.9 | 7.1 | 2.6 | 1.1 | 0.2 | 0 | |
| 22 | at. % | 78 | 6 | 12 | 1 | 3 | 0 | 1.70(**) |
| | wt. % | 88.8 | 7.2 | 2.6 | 0.6 | 0.7 | 0 | |
| 23 | at. % | 78 | 6 | 12 | 3 | 1 | 0 | 1.71 |
| | wt. % | 88.3 | 7.2 | 2.6 | 1.7 | 0.2 | 0 | |
| 24 | at. % | 78 | 6 | 12 | 2 | 2 | 0 | 1.70 |
| | wt. % | 88.5 | 7.2 | 2.6 | 1.1 | 0.5 | 0 | |
| 25 | at. % | 77 | 6 | 12 | 3 | 2 | 0 | 1.66(**) |
| | wt. % | 87.9 | 7.2 | 2.7 | 1.7 | 0.5 | 0 | |
| 26 | at. % | 77 | 6 | 12 | 2 | 3 | 0 | 1.70 |
| | wt. % | 88.2 | 7.3 | 2.7 | 1.2 | 0.7 | 0 | |
| 27 | at. % | 76 | 6 | 12 | 3 | 3 | 0 | 1.65 |
| | wt. % | 87.5 | 7.3 | 2.7 | 1.7 | 0.7 | 0 | |
| 28 | at. % | 76 | 6 | 14 | 3 | 1 | 0 | 1.65(**) |
| | wt. % | 87.6 | 7.3 | 3.1 | 1.7 | 0.2 | 0 | |
| 29 | at. % | 76 | 6 | 15 | 1 | 2 | 0 | 1.69(**) |
| | wt. % | 88.2 | 7.3 | 3.4 | 0.6 | 0.5 | 0 | |
| 30 | at. % | 76 | 6 | 12 | 2 | 4 | 0 | 1.65(**) |
| | wt. % | 87.8 | 7.3 | 2.7 | 1.2 | 1.0 | 0 | |
| 31 | at. % | 76 | 6 | 15 | 2 | 1 | 0 | 1.59 |
| | wt. % | 87.9 | 7.3 | 3.4 | 1.2 | 0.2 | 0 | |
| 32 | at. % | 75 | 6 | 12 | 3 | 4 | 0 | 1.65(**) |
| | wt. % | 87.2 | 7.4 | 2.7 | 1.8 | 1.0 | 0 | |
| 33 | at. % | 75 | 6 | 14 | 3 | 2 | 0 | 1.65 |
| | wt. % | 87.2 | 7.4 | 3.2 | 1.8 | 0.5 | 0 | |
| 34 | at. % | 75 | 6 | 15 | 3 | 1 | 0 | 1.68 |
| | wt. % | 87.3 | 7.4 | 3.4 | 1.8 | 0.3 | 0 | |
| 35 | at. % | 74 | 6 | 14 | 3 | 3 | 0 | 1.64(**) |
| | wt. % | 86.9 | 7.4 | 3.2 | 1.8 | 0.8 | 0 | |
| 36 | at. % | 74 | 6 | 12 | 4 | 4 | 0 | 1.62(**) |
| | wt. % | 86.5 | 7.4 | 2.7 | 2.4 | 1.0 | 0 | |
| 37 | at. % | 74 | 6 | 15 | 3 | 2 | 0 | 1.65(**) |
| | wt. % | 86.9 | 7.4 | 3.4 | 1.8 | 0.5 | 0 | |
| 38 | at. % | 73 | 6 | 14 | 3 | 4 | 0 | 1.55 |
| | wt. % | 86.5 | 7.5 | 3.2 | 1.8 | 1.0 | 0 | |
| 39 | at. % | 73 | 6 | 15 | 3 | 3 | 0 | 1.60 |
| | wt. % | 86.5 | 7.5 | 3.4 | 1.8 | 0.8 | 0 | |

TABLE III-continued

Values for saturation induction, $B_s$, obtained from various metallic glasses belonging to this invention.

| No. | | Fe | Co | B | Si | C | Mn | $B_s$ (T) |
|---|---|---|---|---|---|---|---|---|
| 40 | at. % | 72 | 6 | 15 | 3 | 4 | 0 | 1.62(**) |
| | wt. % | 86.1 | 7.6 | 3.5 | 1.8 | 1.0 | 0 | |
| 41 | at. % | 78 | 7 | 12 | 2 | 1 | 0 | 1.71 |
| | wt. % | 87.7 | 8.3 | 2.6 | 1.1 | 0.2 | 0 | |
| 42 | at. % | 77 | 7 | 12 | 2 | 2 | 0 | 1.71 |
| | wt. % | 87.4 | 8.4 | 2.6 | 1.1 | 0.5 | 0 | |
| 43 | at. % | 76 | 7 | 12 | 2 | 3 | 0 | 1.70 |
| | wt. % | 87.0 | 8.5 | 2.7 | 1.2 | 0.7 | 0 | |
| 44 | at. % | 75 | 7 | 12 | 2 | 4 | 0 | 1.66 (8*) |
| | wt. % | 86.6 | 8.5 | 2.7 | 1.2 | 1.0 | 0 | |
| 45 | at. % | 80 | 2 | 14 | 3 | 0 | 1 | 1.57(**) |
| | wt. % | 91.6 | 2.4 | 3.1 | 1.7 | 0 | 1.1 | |
| 46 | at. % | 78 | 6 | 12 | 3 | 0 | 1 | 1.60 |
| | wt. % | 87.5 | 7.1 | 2.6 | 1.7 | 0 | 1.1 | |
| 47 | at. % | 76 | 6 | 14 | 3 | 0 | 1 | 1.61 |
| | wt. % | 86.8 | 7.2 | 3.1 | 1.7 | 0 | 1.1 | |

(*)Assumed density of $7.3 \times 10^3$ (kg/m$^3$)
(**)Assumed density of $7.35 \times 10^3$ (kg/m$^3$)

Figure 5:
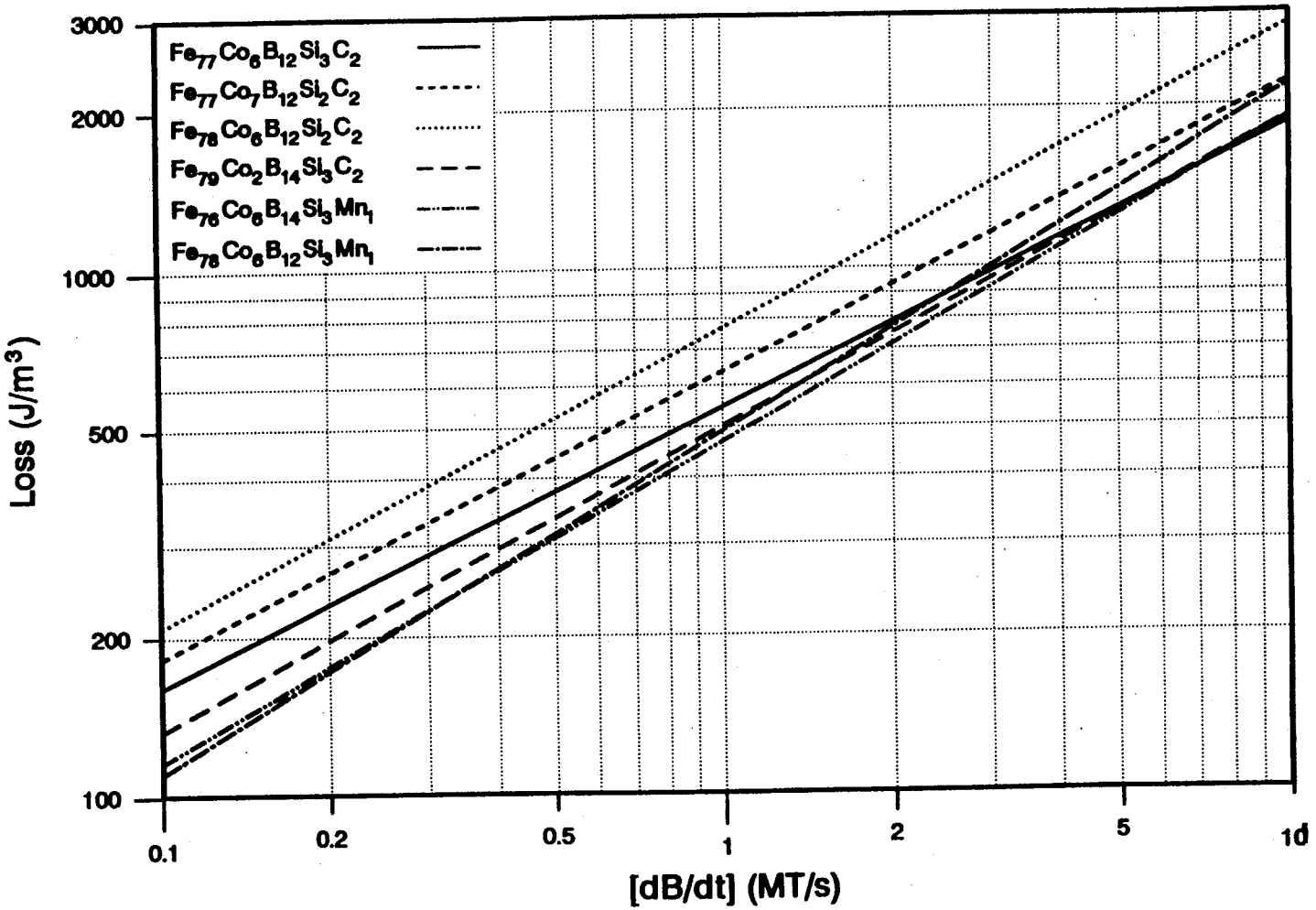
FIG. 5 is a plot, on a log-log scale, of the core loss obtained from various preferred metallic glasses of the invention, as a function of the magnetization rate, (dB/dt); and, FIG. 6 in a similar plot, for the same alloys as in FIG. 5, shows the dependence of H (ave.) on (dB/dt).
Figure 6:
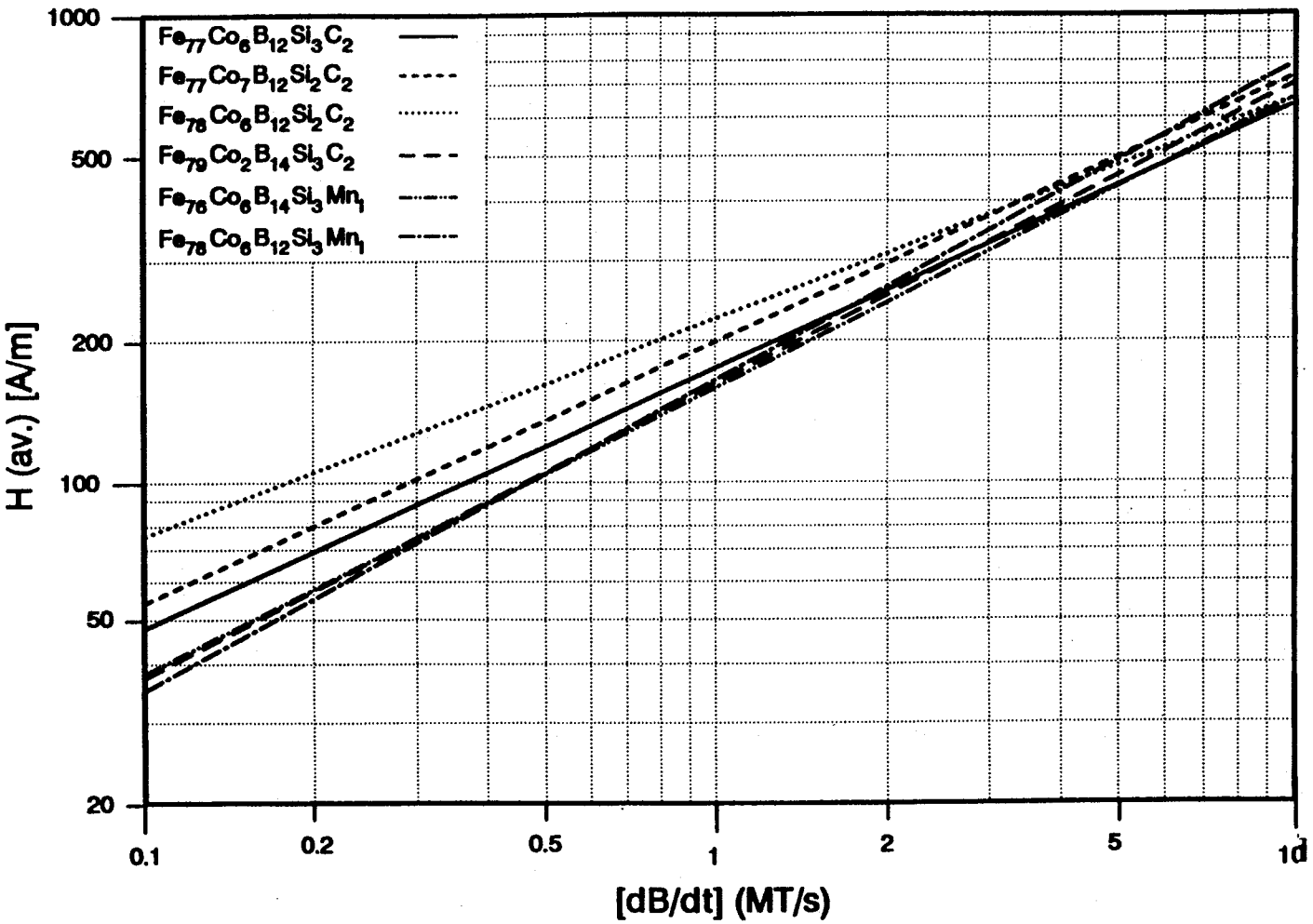

To illustrate by example these measured magnetic characteristics of the alloys of this invention, values for the core loss and the average field, as a function of the magnetization rate, obtained from six of the alloys in Table III, are presented in FIGS. 5 and 6, respectively.

A potential source of error in the above measurements is due to the pick-up of (dB/dt) in air, also encircled by the secondary winding. To minimize this effect, some toroidal cores were prepared with the one turn secondary encircling only the core material. The data in FIGS. 2–4 were derived using this configuration.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A method for making a magnetic core useful at magnetization rates greater than about 1 Mt/s, comprising the steps of:

a. forming a melt of metallic glass having a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" ranges from about 0.5 to about 2, with up to about 1 atom percent of Mn being optionally present in the glass;

b. rapidly solidifying said glass at a rate of at least about $10^{4°}$ C./sec by directing said melt into contact with a moving quench surface, said glass upon solidification having the form of a ribbon that is at least 80% glassy;

c. winding said ribbon to form a core having the shape of a toroid; and d. annealing said core at a temperature ranging from about 573 to 623; K for a time ranging from about 900 s to 3600 s under an external field having strength ranging from about 400 to 1600 A/m, said core, after annealing, having saturation induction ranging from about 300 J/m$^3$ to 400 J/m$^3$ and a dc swing from negative remanence to positive saturation ranging from about 2.9T to 3.2T.

2. The method of claim 1, wherein said core material has a composition selected from the group consisting of $Fe_{75}Co_6B_{14}Si_3C_2$, $Fe_{77}Co_6B_{12}Si_3C_2$, $Fe_{78}Co_6B_{12}Si_3C_1$, $Fe_{79}Co_2B_{14}Si_3C_2$, $Fe_{76}Co_6B_{15}Si_1C_2$, $Fe_{77}Co_7B_{12}C_2$, $Fe_0Co_6B_{11}Si_1$, $C_2$, $Fe_{78}Co_6B_{12}Si_2C_2$, and $Fe_{79}Co_6B_{12}Si_2C_1$.

* * * * *

UNITED STATES PATENT AND TRADEMARK OFFICE

CERTIFICATE OF CORRECTION

PATENT NO. : 5,296,049

DATED : March 22,1994

INVENTOR(S) : Ramanan et al.

It is certified that error appears in the above-identified patent and that said Letters Patent is hereby corrected as shown below:

Col. 10, line 38, replace "Mt/s" with --MT/s--.

Col. 10, line 56, delete ";" should read --insert "°".

Col. 10, line 59, insert --ranging from about 1.55 T to 1.75T, magnetic anisotropy energy--.

Col. 10, lines 64-65, replace $Fe_{78}Co_6B_{12}Si_3C_1Fe_{79}Co_2B_{14}Si_3C_2$" with --$Fe_{78}Co_6B_{12}Si_3C_1$, $Fe_{79}Co_2B_{14}Si_3C_2$-

Col. 10, line 65, replace "$Fe_{77}Co_7B_{12}C_2$" with --$Fe_{77}Co_7B_{12}Si_2C_2$--.

Col. 10, line 66, replace "$Fe_0Co_6B_{11}Si_1$, $C_2$" with --$Fe_{80}Co_6B_{11}Si_1C_2$--.

Signed and Sealed this

Twentieth Day of December, 1994

*Attest:*

Bruce Lehman

BRUCE LEHMAN

*Attesting Officer*

*Commissioner of Patents and Trademarks*